US005624470A

United States Patent [19]

Tanca

[11] Patent Number: 5,624,470

[45] Date of Patent: Apr. 29, 1997

[54] BLACK LIQUOR GASIFICATION WITH INTEGRATED WARM-UP AND PURGE

[75] Inventor: Michael C. Tanca, Tariffville, Conn.

[73] Assignee: Combustion Engineering, Inc., Windsor, Conn.

[21] Appl. No.: 577,386

[22] Filed: Dec. 22, 1995

[51] Int. Cl.[6] ..... D21C 11/12

[52] U.S. Cl. ..... 48/87; 48/192; 422/185

[58] Field of Search ..... 48/87, 192; 422/185; 162/29, 30.1, 30.11

[56] References Cited

U.S. PATENT DOCUMENTS

| | | | |
|---|---|---|---|
| 3,867,251 | 2/1975 | Holme . | |
| 4,303,469 | 12/1981 | DiNovo et al. | 422/185 |
| 4,526,760 | 7/1985 | Empie, Jr. . | |
| 4,536,253 | 8/1985 | Bertelsen . | |
| 4,761,204 | 8/1988 | Kohl et al. | 422/185 |
| 4,823,739 | 4/1989 | Marcellin . | |
| 4,872,950 | 10/1989 | Andersson et al. . | |
| 4,930,429 | 6/1990 | Ryham . | |
| 4,969,930 | 11/1990 | Arpalahti . | |
| 5,284,550 | 2/1994 | Tanca et al. . | |
| 5,425,850 | 6/1995 | Tanca et al. . | |

OTHER PUBLICATIONS

K. Salmenoja et al., "Development of Black Liquor Gasification", TAPPI Proceedings, 1993 Engineering Conference, pp. 969 – 975.

R. Backman et al., "Equilibrium behaviour of sodium, sulfur and chlorine in pressurized black liquor gasification with addition of titanium dioxide," Paper and Timber, vol. 76, No. 5, 1994, pp. 320 – 325.

R.E. Scott–Young et al., "Commercial Development of the DARS Process," 1995 International Chemical Recovery Conference, pp. B263 – B267.

*Primary Examiner*—Timothy McMahon

*Attorney, Agent, or Firm*—Chilton, Alix & Van Kirk

[57] ABSTRACT

A kraft black liquor gasification system is provided with a hot flue gas generator which serves both as a means for generating a hot flue gas to warm-up the gasifier in preparation for start-up and as a means for generating an inert purge gas to purge the gasifier of flammable gases in the event of an emergency trip of the gasifier. A control system controls the operation of the burner during warm-up in response to the gasifier temperature and during the purge in response to the purge gas composition and temperature.

6 Claims, 5 Drawing Sheets

BLACK LIQUOR GASIFICATION WITH INTEGRATED WARM-UP AND PURGE

BACKGROUND OF THE INVENTION

This invention relates to a system and process for the processing of the spent black liquor from a kraft pulping process to recover the chemicals and produce fresh pulping liquor. More specifically, the system and process of this invention relate to an integrated system for the warm-up of the gasifier during start-up and for purging the gasifier in emergencies.

The kraft pulping process employs an alkaline pulping liquor, known as white liquor, to react with the lignins in the wood and free the fibrous portions. Following a series of filtering and washing steps, the fibrous portion is separated as raw pulp and the remaining spent cooking liquor, which is dark in color, is known as weak black liquor. This liquor, which is approximately 85% water, is then subjected to a series of various types of evaporation to produce strong black liquor with solids content greater than 50%. The strong black liquor is then ready for the chemical recover phase.

The typical prior art process for treating black liquor to recover chemicals employs what is commonly referred to as a chemical recovery furnace. In these furnaces, which are operated as boilers for the generation of steam, the strong black liquor is fired to burn the organic content and to form a smelt composed primarily of sodium sulfide and sodium carbonate. This smelt is drained from the smelt bed in the bottom of the furnace, dissolved in water to form green liquor and then causticized to form the white pulping liquor containing sodium sulfide and sodium hydroxide.

One of the problems with these typical chemical recovery furnaces has to do with the fact that there is a very hot pool of smelt in the bottom of the furnace and the fact that the furnace is lined with waterwall tubes. If there is a rupture in a waterwall tube and water is leaked onto the smelt bed, there is the potential for a violent explosion which produces high pressures and which can actually blow the furnace apart. It can be seen that systems and processes which avoid this problem would be very beneficial to paper companies.

U.S. Pat. No. 5,284,550 entitled "Black Liquor Gasification Process Operating At Low Pressure Using A Circulating Fluidized Bed," which issued Feb. 8, 1994 and U.S. Pat. No. 5,425,850 entitled "CFB Black Liquor Gasification System Operating At Low Pressures," which issued Jun. 20, 1995 and which are both assigned to the same assignee as the present application, describe and claim one such system and process for replacing a chemical recovery furnace. These patents also discuss as background information, a number of other patents and publications which have attempted in one way or another to solve chemical recovery furnace problems. Referring to the subject matter of U.S. Pat. Nos. 5,284,550 and 5,425,850, they basically involve the replacement of the chemical recovery furnace with a black liquor gasification system using an atmospheric pressure circulating fluidized bed reactor arrangement including the arrangement for processing the gases and solids which are produced to generate fresh cooking liquor. The present invention constitutes a modification for use with that system and process so it will be more fully described hereinafter. However, these two U.S. Pat. Nos. 5,284,550 and 5,425,850 are incorporated herein by reference.

SUMMARY OF THE INVENTION

The present invention relates to kraft black liquor gasification and provides an integrated system and method both for warming the gasifier during start-up and for purging the gasifier of flammable gases after emergency trips. A warm-up burner fired with an auxiliary fuel is employed to heat the gasifier with hot flue gases up to the required ignition temperature prior to the firing of the black liquor. This same burner is used to generate inert flue gas to purge the gasifier when needed. A control system integrates the dual function of the burner including temperature and oxygen level control.

DESCRIPTION OF THE PREFERRED EMBODIMENT

Figure 1:
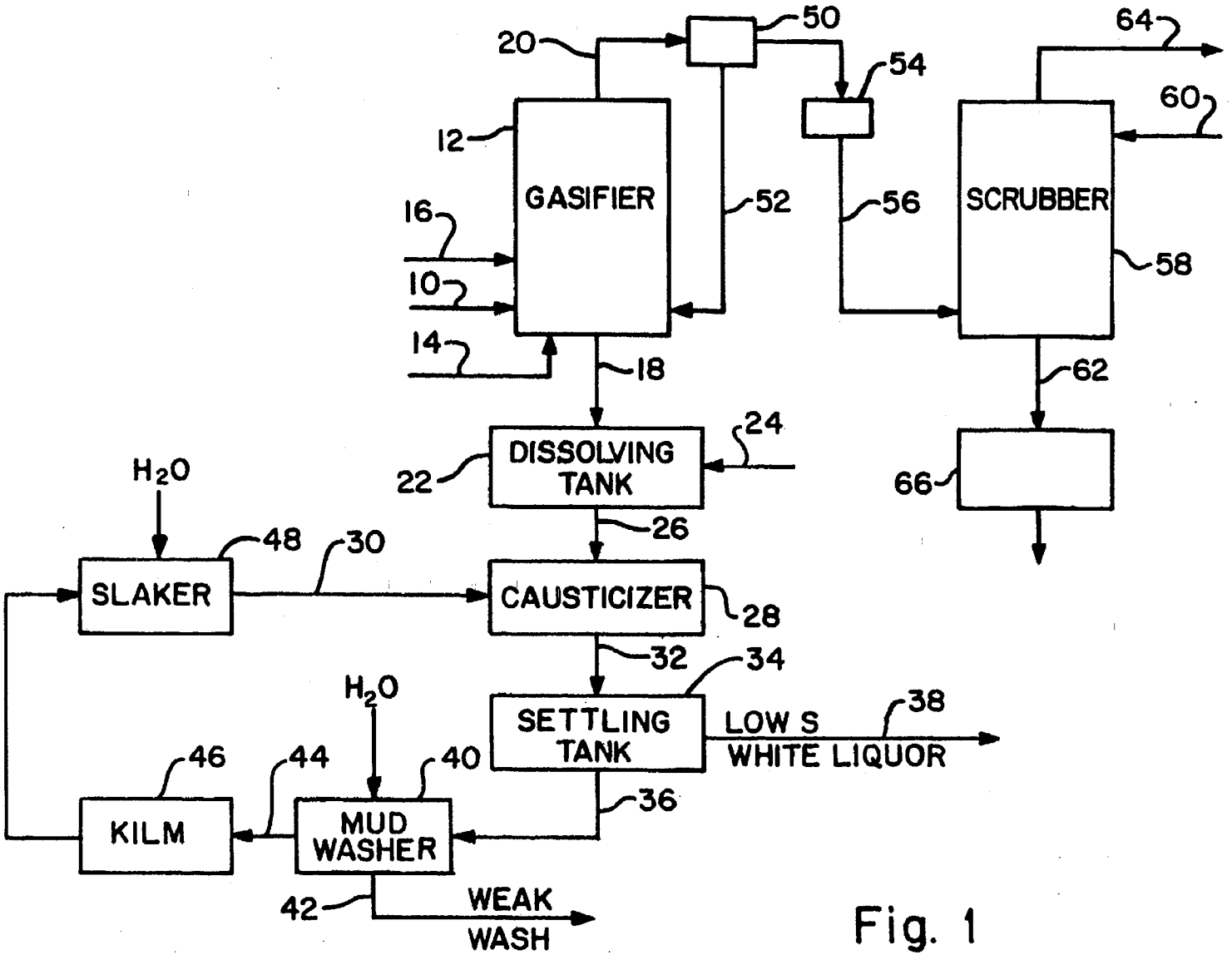
FIG. 1 is a process flow diagram of a black liquor gasification process with which the present invention could be employed.

FIG. 1 is a representation of the process flow diagram for a black liquor gasification system as described in the previously mentioned prior U.S. Pat. Nos. 5,284,550 and 5,425,850. Strong black liquor 10 derived from the pulp digestion process is fed to the circulating fluidized bed gasifier 12. Fluidizing air 14 and reaction air 16 are also fed into the gasifier 12 all as taught by the two prior patents previously identified. The gasification process is carried out with substoichiometric oxygen levels and the total air to the gasifier is generally in the range of 20% to 50% of stoichiometric which results in the gasification of more than 60% and up to 99% of the sulfur contained in the black liquor. The remaining sulfur reacts with sodium to form $Na_2S$ which remains a solid and is discharged out the bottom along with the $Na_2CO_3$ and any unreacted $Na_2SO_4$. The solids which are formed, primarily $Na_2CO_3$, are collected and drained from the bottom of the gasifier as bottoms solids stream 18 while the gas product 20 is removed from the top of the gasifier 12. The gas stream 20 contains primarily $H_2S$ in addition to the other products of the substoichiometric oxidation process, namely $CO_2$, CO, $H_2$, $H_2O$, $CH_4$ and $N_2$.

The bottoms stream 18 from the gasifier 12, which is a solids stream containing primarily $Na_2CO_3$ but with some small amount of $Na_2S$, is fed to the dissolving tank 22. The solids are dissolved in a liquid stream 24 which may be water or a weak liquor or scrubber liquor stream to form green liquor. The resulting green liquor stream 26 contains more than 70% and up to 95% sodium carbonate on a mole basis.

The green liquor stream 26 is fed to the causticizer 28 where slaked line, $Ca(OH)_2$, is added from line 30 to convert the $Na_2CO_3$ to NaOH and $CaCO_3$. The slurry 32 from the causticizer 28 is fed to the settling tank 34 where the solids, primarily $CaCO_3$, are separated out as a sludge 36 leaving the low sulfide white liquor stream 38. The $CaCO_3$ sludge 36 is washed with water in the mud washer 40 leaving a weak wash stream 42 which can be used in the plant, as needed. The washed $CaCO_3$ 44 is fed to the kiln 46 for calcining to CaO and then to the slaker 48 for conversion back to $Ca(OH)_2$. The white liquor stream 38 is composed mainly of NaOH with small amounts of $Na_2S$ and is recycled to the digester.

The gas product 20 from the gasifier 12 would first be cleaned of entrained particulate material at 50 by some form of mechanical separator such as a cyclone with the removed solids being recycled at 52 back to the gasifier. The remaining gas stream from the solids separating means 50 may be cooled at 54 down to the saturation temperature for the recovery of heat. If any additional fine dust removal is needed, the gas would then be sent through an electrostatic precipitator, bag filter or some other form of dust removal equipment (not shown). For further details of the mechanical separation, cooling and dust removal, see the previously mentioned prior U.S. Pat. Nos. 5,284,550 and 5,425,850.

The cleaned and cooled gas product stream 56 is fed to the sulfur recovery scrubber 58. The scrubber 58, which operates in a known manner, employs a liquor stream 60 containing sodium compounds ($Na_2CO_3$ and NaOH) to react with the sulfur compounds, primarily $H_2S$ with some COS, to form a liquor stream 62. Regarding the scrubbing liquor stream 60, it may in fact be several different liquor streams from various sources in the plant. The clean overhead gas 64 from the scrubber 58 now contains primarily CO, $CO_2$, $H_2$, $H_2O$ and $N_2$. There is sufficient heating value in this gas stream 64 so it is typically burned in combustion equipment such as a steam generator or lime kiln. The liquor stream 62 from the scrubber 58 contains primarily $Na_2S$ from the absorption of $H_2S$ by sodium compounds. This green liquor stream 62 is fed to a holding tank 66 from which it is used to prepare a high sulfide white liquor stream which will typically involve another causticizing operation for the $Na_2CO_3$.

Figure 2:
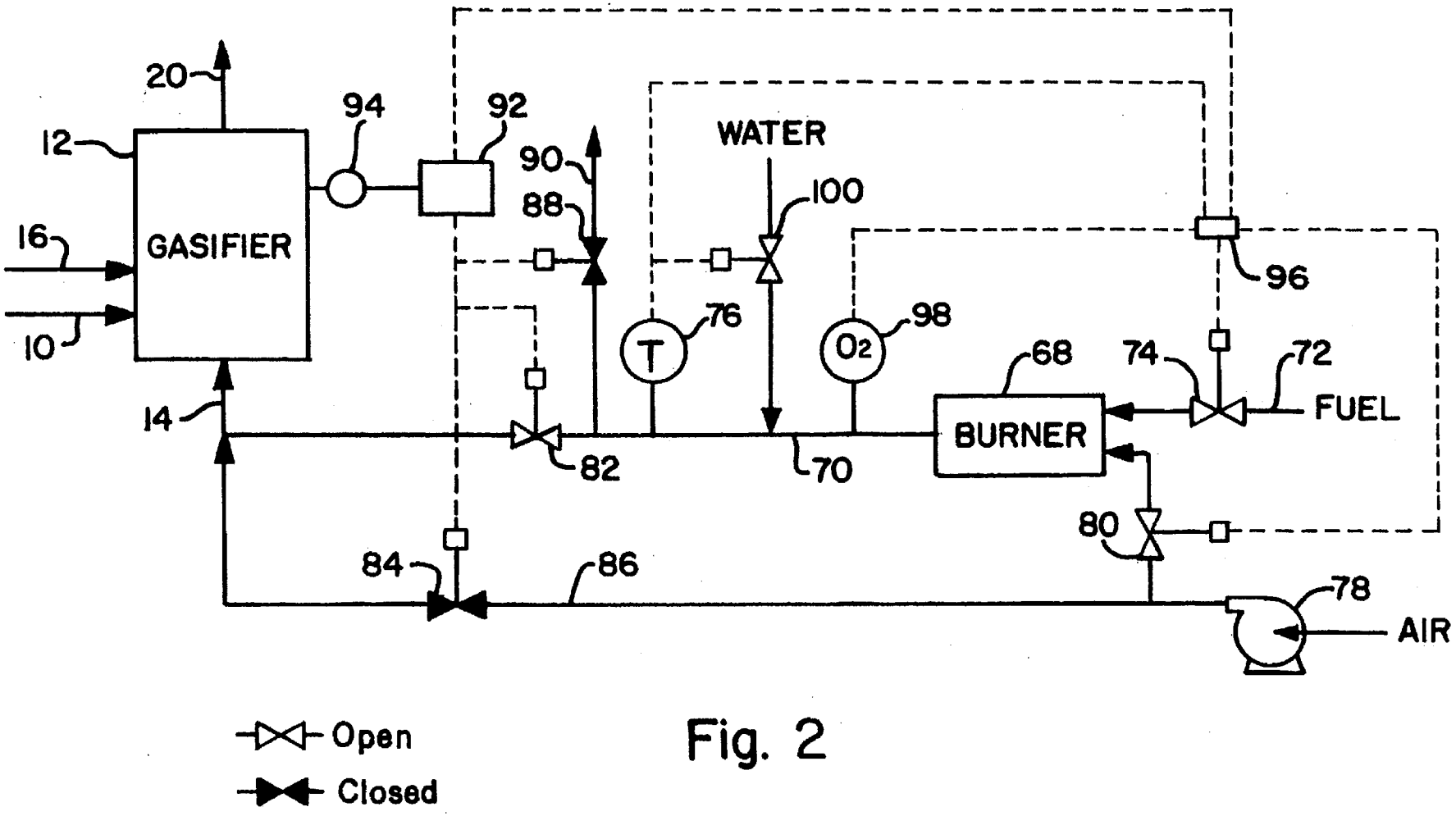
FIG. 2 is a process flow diagram illustrating the present invention during the warm-up phase.

The firing of the black liquor 10 in the gasifier 12 requires that the gasifier and the solids contained in the gasifier (calcium compounds) be at the ignition temperature of the black liquor before the black liquor is fed into the gasifier. Referring to FIG. 2, which illustrates the system in the warm-up mode, the gasifier 12 is warmed-up using the warm-up burner 68. This may be a burner of any desired type that is adapted to burn a fuel, usually oil or gas, to generate a hot flue gas. The hot flue gases flow from the burner 68 to the gasifier in the duct 70 which may be connected into the fluidizing air duct 14 as illustrated. The fuel flow to the burner 68 in line 72 is controlled by the valve 74 in response to the temperature of the flue gas in the duct 70 measured at 76. The air flow to the burner 68 from the compressor 78 is controlled by the damper 80 which is connected in with the controls for the fuel flow such that the rate of fuel flow and the rate of air flow are coordinated for proper combustion. In this warm-up mode, the burner outlet damper 82 in duct 70 is open so that the hot flue gases flow to the gasifier. The damper 84 in the burner bypass line 86 is closed as is the damper 88 in the bypass stack 90. The purpose of the bypass stack 90 will be apparent hereinafter. The purpose of the burner bypass line 86 is two-fold. The first purpose is to supply the fluidizing/combustion air to the gasifier from the compressor 78 during the normal operation of the gasifier when firing black liquor. The second purpose relates to the purge of the gasifier which will become clear later.

The dampers 82, 84 and 88 are sequenced and controlled from the control unit 92. The control unit 92 may be manually operable or it may be automatic at least for certain modes. For example, the control unit 92 may be connected in with a sensor unit 94 which detects one or more conditions of the gasifier. The sensor unit 94 may detect the gasifier temperature to control the warm-up mode, detect a gasifier trip to initiate the purge mode to be described hereinafter and detect the gas composition in the gasifier to monitor the progress of the purge. The control unit 92 may likewise be connected into the burner fuel and air control unit 96 to control the burner operation and sequence during those modes.

Once the gasifier has been warmed-up to the ignition temperature of the black liquor, black liquor firing is commenced. At that point, valves 74 and 80 are closed to cut off the fuel and air to the warm-up burner 68 and damper 84 is opened to supply fluidizing/combustion air to the gasifier. Damper 82 is closed and damper 88 remains closed. The valves and dampers remain in those positions throughout the normal operation.

When there is a malfunction of the gasifier 12 that would cause a trip or shut-down of the gasifier, the gasifier is loaded with combustible gases. In that event, it is essential that the gasifier be purged of the combustibles and oxygen to avoid a possible explosive condition. In the present invention, that purge is accomplished by using the already existing warm-up burner 68 to generate an inert flue gas for purging.

Figure 3:
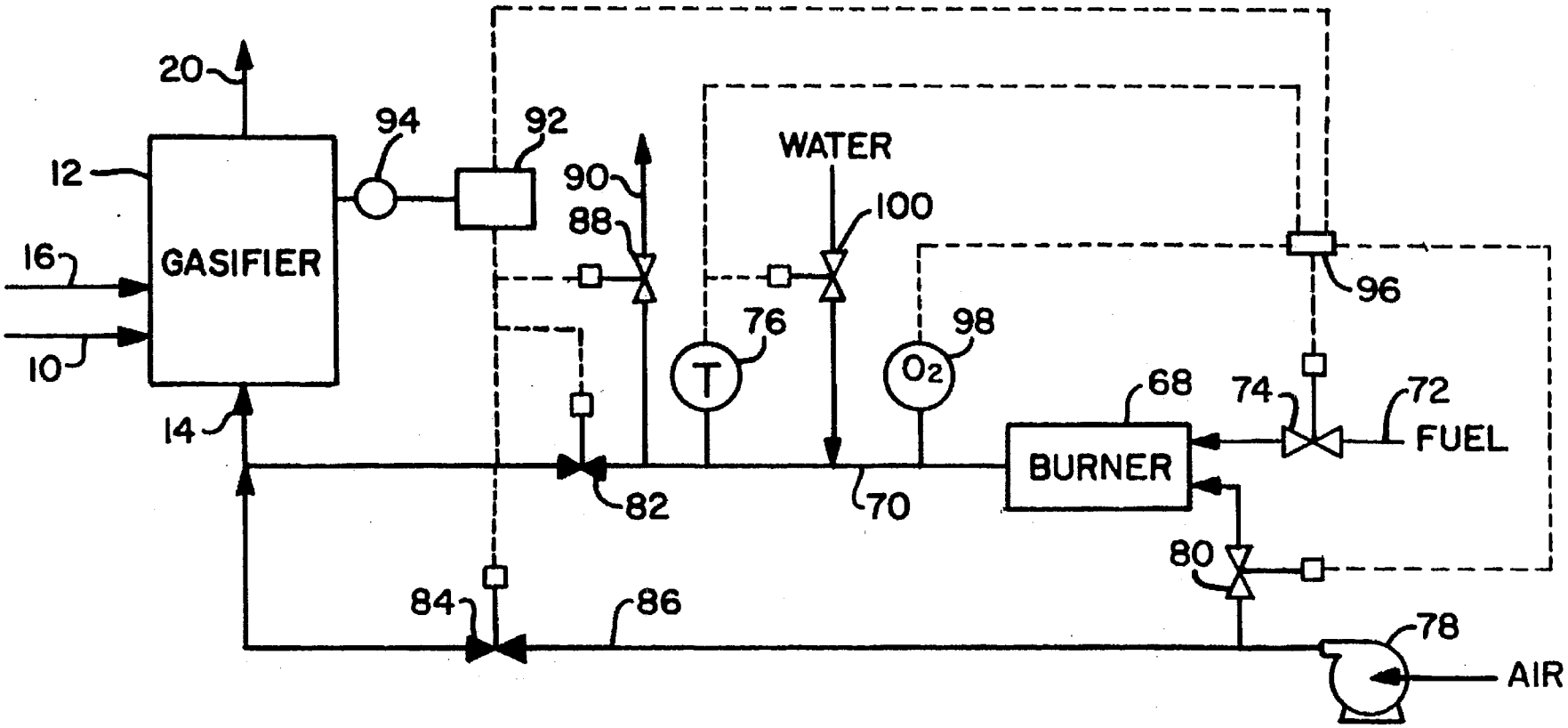
FIG. 3 is a similar process flow diagram during the initial preparation of the purge phase.

When a trip occurs, a signal is sent from the sensor unit 94 through the control unit 92 to the burner control unit 96. This starts the burner 68 by opening valves 74 and 80. At the same time, the damper 88 is opened, damper 84 is closed and damper 82 remains closed. This condition is illustrated in FIG. 3 and involves the initial or preparatory purge mode. In this initial purge mode, the purge gas is vented through the damper 88 in the bypass duct 90 and the conditions of the purge flue gas are monitored and adjusted. The air flow to the burner through damper 80 is adjusted to give the desired purge gas flow rate. The fuel to the burner is adjusted to give the proper fuel/air mixture to produce a desired oxygen level in the purge flue gas as measured at 98. The oxygen level in the purge flue gas must be kept to a minimum, compatible with proper combustion in the burner 68 to prevent the burning of the combustibles remaining in the gasifier. Also, the purge gas to the gasifier may be attemperated with water through valve 100 to keep the gas temperature below the flammability levels of the mixture of gasifier product and purge gas and to prevent solids in the gasifier from melting or agglomerating. This water attemperation may also be used during this purge mode as well as the previously discussed warm-up mode to prevent any possible flue gas temperature above the designed temperature rating of the ductwork.

Figure 4:
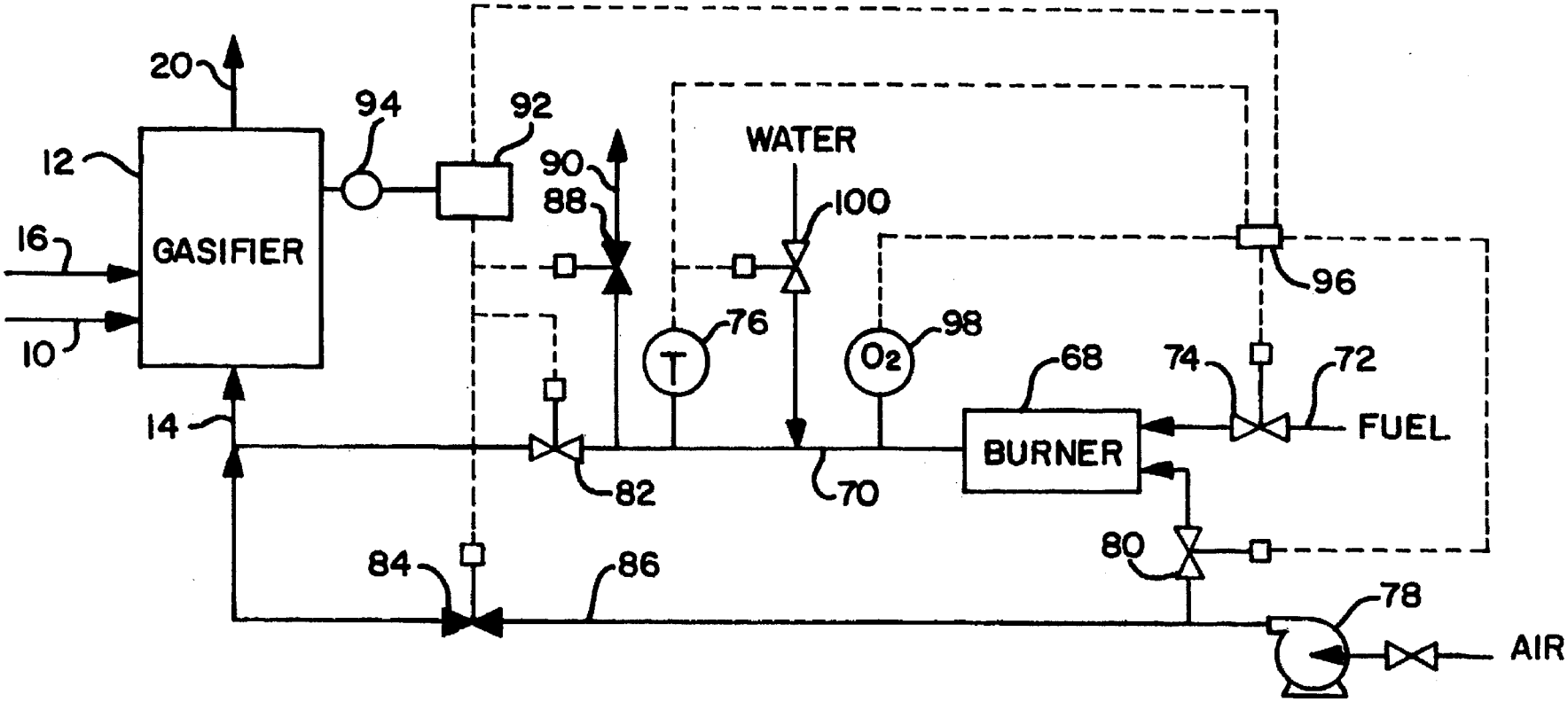
FIG. 4 is another process flow diagram illustrating the purge phase.
Figure 5:
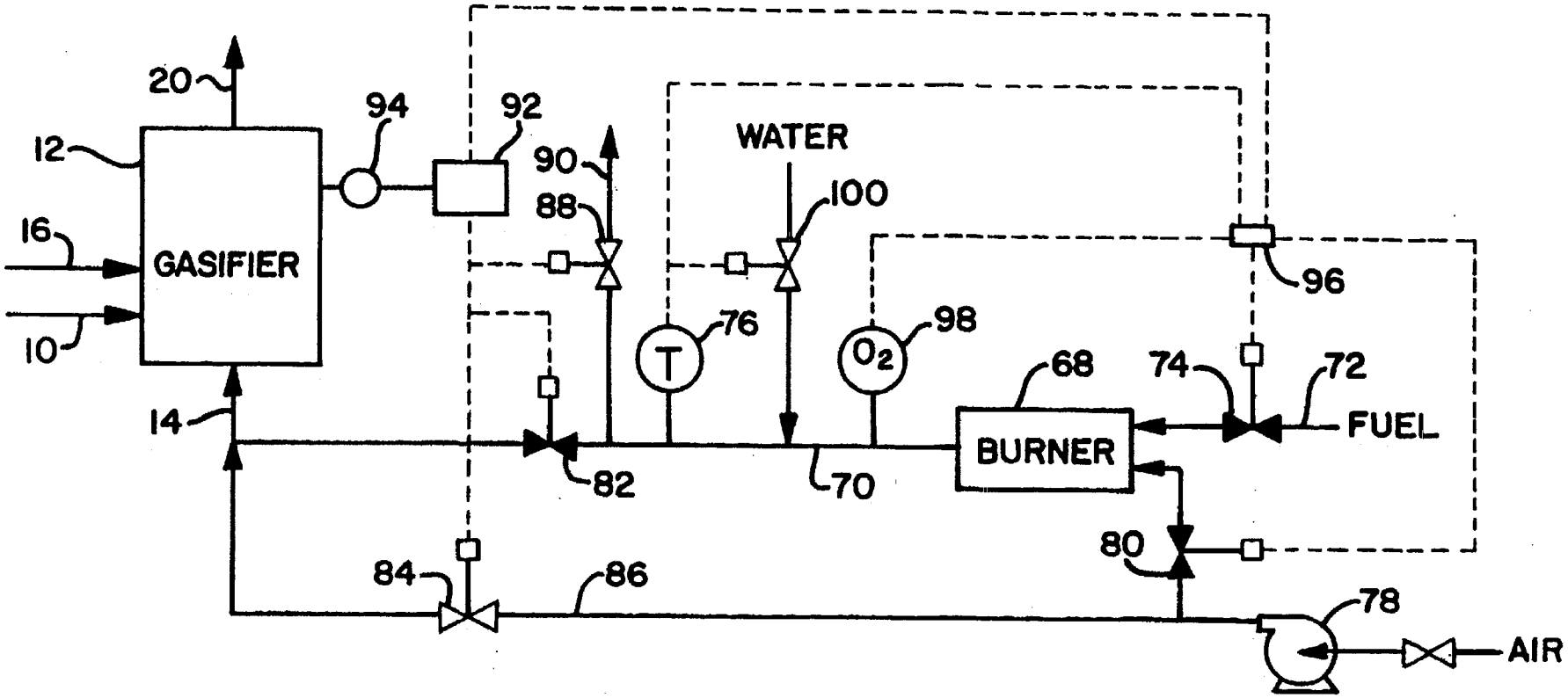
FIG. 5 is also a process flow diagram illustrating the last part of the purge phase.

When the conditions of the purge gas are proper with respect to temperature and composition (oxygen level), the damper 88 is closed and the damper 82 is simultaneously opened so that the purge gas is fed to the gasifier. This is illustrated in FIG. 4. Upon completion of the purge, which may be detected by the sensor unit 94, the fuel to the burner 68 is reduced gradually and stopped. The air flow through damper 80 continues to completely purge the burner 68 with air. The burner outlet damper 82 is then closed and the bypass line damper 84 is opened. This permits the direct flow of air to the gasifier to complete the purge. This mode is shown in FIG. 5.

I claim:

1. A system for warming a black liquor gasifier in preparation for start-up and for purging said black liquor gasifier of flammable gas after a trip comprising:

a. a black liquor gasifier;

b. a hot flue gas generator;

c. means for feeding fuel and combustion air to said hot flue gas generator and burning said fuel and air therein to generate said hot flue gases;

d. means for feeding said hot flue gases from said hot flue gas generator to said black liquor gasifier to warm said gasifier;

e. means for terminating said fuel and air to said hot flue gas generator when said gasifier reaches a selected temperature;

f. means for detecting a gasifier trip requiring the purge of flammable gases therefrom;

g. means responsive to the detection of a gasifier trip for feeding fuel and combustion air to said hot flue gas generator and producing a hot flue gas purge stream;

h. means for feeding said hot flue gas purge stream to said tripped gasifier to purge said flammable gases therefrom.

2. A system as recited in claim 1 wherein said means for feeding combustion air to said hot flue gas generator also includes means for feeding fluidizing air therefrom to said gasifier.

3. A system as recited in claim 1 wherein said means for feeding said hot flue gas purge stream to said tripped gasifier further comprises means for monitoring selected conditions of said hot flue gas purge stream and venting said hot flue gas purge stream around said gasifier until said selected conditions are satisfied.

4. A system as recited in claim 3 wherein said means for monitoring selected conditions includes means for monitoring oxygen levels and temperature.

5. A system as recited in claim 4 and further including means for injecting tempering water into said hot flue gas purge stream.

6. A system as recited in claim 1 and further including means for purging said gasifier with air following said purge with said hot flue gas purge stream.

* * * * *